US006385324B1

(12) United States Patent
Köppen, deceased

(10) Patent No.: US 6,385,324 B1
(45) Date of Patent: May 7, 2002

(54) BROADBAND LOUDSPEAKER

(75) Inventor: Karl Heinz Köppen, deceased, late of Oberhausen (DE), by Renate Köppen, Detlef Köppen, Hans Jürgen Köppen, executors

(73) Assignee: Sorus Audio AG, Oberhausen (DE)

( * ) Notice: Subject to any disclaimer, the term of this patent is extended or adjusted under 35 U.S.C. 154(b) by 0 days.

(21) Appl. No.: 09/381,158

(22) PCT Filed: Mar. 17, 1998

(86) PCT No.: PCT/EP98/01526

§ 371 Date: Dec. 22, 1999

§ 102(e) Date: Dec. 22, 1999

(87) PCT Pub. No.: WO98/42160

PCT Pub. Date: Sep. 24, 1998

(30) Foreign Application Priority Data

Mar. 17, 1997 (DE) ..... 197 10 967

(51) Int. Cl.[7] ..... H04R 25/00

(52) U.S. Cl. ..... 381/336; 381/345; 381/349; 181/153

(58) Field of Search ..... 381/304, 305, 381/306, 160, 336, 337, 338, 339, 345, 349, 352; 181/153, 156

(56) References Cited

U.S. PATENT DOCUMENTS

| | | | | |
|---|---|---|---|---|
| 2,145,963 A | | 2/1939 | Adams | |
| 2,401,328 A | * | 6/1946 | Black | 381/346 |
| 3,768,589 A | * | 10/1973 | Nilsson et al. | 381/336 |
| 3,772,466 A | | 11/1973 | Hossbach | |
| 4,063,387 A | * | 12/1977 | Mitchell | 381/160 |
| 4,122,911 A | | 10/1978 | Croup | |
| 4,300,217 A | | 11/1981 | Ballinger | |
| 4,881,265 A | * | 11/1989 | Gala | 381/336 |
| 5,105,905 A | * | 4/1992 | Rice | 381/160 |
| 5,812,685 A | * | 9/1998 | Fujita et al. | 381/336 |

FOREIGN PATENT DOCUMENTS

| | | |
|---|---|---|
| DE | 75 02 568 | 11/1975 |
| DE | 32 41 898 | 7/1984 |
| DE | 36 11 120 | 10/1987 |
| GB | 2 153 628 | 8/1985 |
| GB | 2 250 658 | 6/1992 |

OTHER PUBLICATIONS

*Patent Abstracts of Japan*, vol. 6, No. 123 (E–117) Jul. 8, 1982 of JP 57 050 197 (Yuutopia Kiki), Mar. 24, 1982.

* cited by examiner

*Primary Examiner*—Curtis Kuntz
*Assistant Examiner*—Suhan Ni
(74) *Attorney, Agent, or Firm*—Frishauf, Holtz, Goodman, Langer & Chick, P.C.

(57) ABSTRACT

A broadband loudspeaker radiating as an approximate point source, whose movable components are fastened to a dome-shaped loudspeaker front, wherein the loudspeaker front flares rearwardly to an enclosure shell disposed coaxially around the central axis of the enclosure and a diagonally disposed deflection plane, which can be formed as the back wall, faces the back side of the diaphragm. The inside cross section of the enclosure shell is preferably a polygon with an odd number of sides, as is the dome-shaped loudspeaker front and the loudspeaker diaphragm, which is preferably cup-shaped and which can be fastened directly to the loudspeaker front.

6 Claims, 5 Drawing Sheets

12
15
13
14

5
11
16
3
12
15
13
14

5
11
10
15
16
3

BROADBAND LOUDSPEAKER

CROSS REFERENCE TO RELATED APPLICATION

This application is a U.S. National Phase Application under 35 USC 371 of International Application PCT/EP98/01526 (not published in English), filed Mar. 17, 1998.

BACKGROUND OF THE INVENTION

1. Field of the Invention

The invention relates to a broadband loudspeaker radiating as an approximate point source, with improved reproduction characteristics.

In this connection, the concept of the invention is oriented in the ideal case toward a point source which is as small as possible and radiates spherical sound waves.

2. Background Information

In general, enclosures have a large influence on the acoustic characteristics of a loudspeaker, since each enclosure shape and type as well as the arrangement of the sound transducer in the enclosure have very characteristics effects on reproduction quality. The reproduction defects caused by enclosures are subsequently very difficult if not completely impossible to correct even by digital techniques, and are due primarily to the following causes:

1. Standing waves develop in the enclosure, and have an interfering effect on the back side of the diaphragm.
2. In the diffraction-frequency range and therebelow, the sound waves are diffracted at the outside edges of the loudspeaker front, thus leading to irregular drop in amplitude in the case of unfavorable enclosure shapes.
3. Cylindrical waves are formed along straight enclosure edges, and become superposed on (interfere with) the direct sound in a manner which depends on listening angle.
4. Depending on enclosure construction and materials used, material resonances of varying intensity develop, and front and back panels vibrate.

As regards the aforementioned defect sources, the most unfavorable of the common enclosure shapes has proved to be the cube which, when the chassis is installed in central position, produces powerful standing waves and, at the outside edges of the loudspeaker front, strong cylindrical waves. A widely adopted compromise is the rectangular enclosure with three different edge lengths, because the standing waves are divided among three frequencies and therefore are not as pronounced. Another option is additionally installed acoustic reflectors, which are intended to reduce this effect. Pyramidal enclosures achieve similar purposes. Interference defects can then be somewhat alleviated by chamfering the edges. Defects due to diffraction and superposition are minimized by spherical enclosures, as shown by German Utility Model DE-GM 7502568, although without additional measures a sphere produces the strongest standing waves. An advantage in the cited utility model is the fact that the diaphragm is fastened directly to the enclosure. As illustrated in the drawing, however, the position of the diaphragm relative to the outside edge of the enclosure is so ill-chosen that the advantages of the spherical enclosure front are ineffective.

Further defects are caused by the diaphragm:

5. Concentration of the radiated sound waves at higher frequencies begins starting from "fb" [$fb=C/(\pi \cdot d)$; fb=concentration frequency; C=velocity of sound; d=diaphragm diameter] (the formula is for a plane diaphragm, but a conical diaphragm in principle produces even more pronounced concentration).
6. Depending on material properties (torsional stiffness, internal damping, etc.), material resonances in the form of partial vibrations (interfering extraneous sound due to partial diaphragm deformation) occurs at several frequencies.
7. Defects due to the diaphragm suspension (wobbling movements) in the case of cup-shaped diaphragms.
8. Defects caused by the diaphragm suspension and centering (mass/spring effect), which defects resemble the case of a 2nd order filter and result in an amplitude drop at the lower frequency limit.

The most serious defects as regards stereophonic reproduction quality, however, are caused by different transit times of the sound waves in the case of noncoaxial multichannel systems. Transit-time defects occur even if the diaphragms are disposed on one plane. High-fidelity three-dimensional reproduction of a recording with two microphones is therefore impossible or is approximately possible only for a listening station which is fixed in position. Reverberation effects also occur, giving the impression among others of synthesized stereophonic sound and greater sound volume.

Accordingly, it seems that a coaxial loudspeaker could be suitable for eliminating these defects. Coaxial loudspeakers are known in the form of cone/cup and cone/horn combinations. For both types the sound exit for the treble range is located in the mouth of a cone. The diaphragm, which in any case already modulates the treble component allocated thereto, is also acted on by the sound waves of the treble system—more in the case of a cup, somewhat less in the case of a horn. Another disadvantage is that the sound components of the cup, which otherwise radiates in a wide angle, are concentrated by the cone to a degree which depends on frequency. In the case of the horn, the multiple reflections at the inside walls of the horn body cause interference in several respects. A practical principle is found in the coaxial design of a treble/middle-range cup-shaped loudspeaker from GB 2250658, but it does not provide any information as regards suppression of partial vibrations. These aforesaid defects lead in some cases to considerable harmonic distortions.

SUMMARY OF THE INVENTION

The object of the invention is therefore to provide a loudspeaker with improved reproduction characteristics, in which the described defects are largely avoided.

The object is achieved by two embodiments according to the invention.

In the first embodiment the dome-shaped loudspeaker front offers the advantage that the sound pressure waves are refracted gradually and not abruptly at outside edges of the enclosure. Thereby neither interferences nor irregularities develop in the amplitude-frequency curve. The transition region between the conditions at an infinite baffle and those at the end of a long tube progresses smoothly in this case. The sound pressure decreases regularly down to −6 dB and can be easily compensated for—by impedance equalization, for example, in the case of a passion solution—by a known circuit in the signal channel. Such a circuit compensates for the drop in sound pressure below the diffraction frequency ($f_d$), because it permits the level to be lowered as a function of frequency, with a cutoff frequency equal to $f_d$. Thereby the frequency response is linearized and the amplitude-frequency response of an infinite baffle is established.

In the interior of this dome, the axially radiated sound waves are guided directly into the back portion of the enclosure, while the radially radiated sound components are guided thereinto by the conically disposed deflecting surfaces. There they impinge on the deflection plane, which is disposed preferably at an angle of 45 ° and can be formed by the back wall of the enclosure. It deflects the sound waves such that they are reflected numerous times at the inside walls of the enclosure shell, which preferably has a polygonal cross section. They must pass several times through damping material placed in the enclosure cavity. Axial standing waves cannot develop.

Because the inside cross section of the enclosure is a polygon with an odd number of sides, radial standing waves are distributed over several frequencies—depending on the number of segments—and thus are already greatly attenuated before they are also eliminated by the damping material.

The extremely stable enclosure structure has extremely low resonance, making it possible to do without the usual loudspeaker frame and to fasten the diaphragm suspension and the driver unit directly in the enclosure, provided aluminum or plastic, for example, are used as the materials.

The other embodiment comprises improving the diaphragm radiation in itself.

To improve the concentration behavior of the loudspeaker diaphragm, or in other words to widen the radiation angle, the diaphragm is designed as a cup. Consequently almost perfect radiation behavior in the described transition region is achieved in combination with a dome-shaped loudspeaker front.

Partial vibrations of the diaphragm are greatly suppressed if the cup-shaped diaphragm is divided into stabilizing segments by providing it with a polygonal cross section. If in addition an unsymmetric subdivision is chosen, the vibration fields, which primarily occur in opposite positions, cannot build up. By bending the rim region inward to obtain a circular flange, additional shape stability is obtained and a plane for fastening the diaphragm suspension is created.

The division of the diaphragm into two zones and the elastic connection of the zones with each other—for which purpose a specified permanently elastic adhesive can be used—once again improves the radiation behavior, or in other words minimizes concentration phenomena, and also improves the efficiency for high frequencies. The discontinuity which the elastic coupling causes in the amplitude-frequency response can be corrected with a bandpass filter. Division into further annular zones is possible to a limited extent. The coil former is always fastened at the center. Wobbling movements of the diaphragm can be prevented with a centering axis which is supported at one or both ends, and which preferably comprises a light hollow member. The centering spider, which causes interference (damping and reflection), can be dispensed with.

Finally, FM distortions can be reduced by decoupling the center zone from the annular zone and providing it with its own driver and its own diaphragm suspension. The driver of the center zone has space in front of the driver for the annular zone, and the center zone can also be represented by a complete baffle element such as a neodymium cup. The inner diaphragm suspension of the annular zone is fastened to this driver or sound transducer, thus simultaneously ensuring complete sealing relative to the enclosure. Depending on material properties of the diaphragm suspensions, adequate centering and zeroing is possible by this expedient alone. Any slight phase discrepancy can be corrected electronically. The attached enclosure leads back to the first method, but can be, for example, a spherical enclosure with appropriate internal contour.

As a result, the basic structure of the loudspeaker—assuming it is placed with adequate clearance (not too close to walls)—already makes possible amazingly realistic stereophonic reproduction of properly recorded sound events. It is also preconditioned as well as possible for active preprocessing of the audio signals if, among other requirements, the full dynamic range is to be utilized.

DETAILED DESCRIPTION OF THE INVENTION

Figure 1:
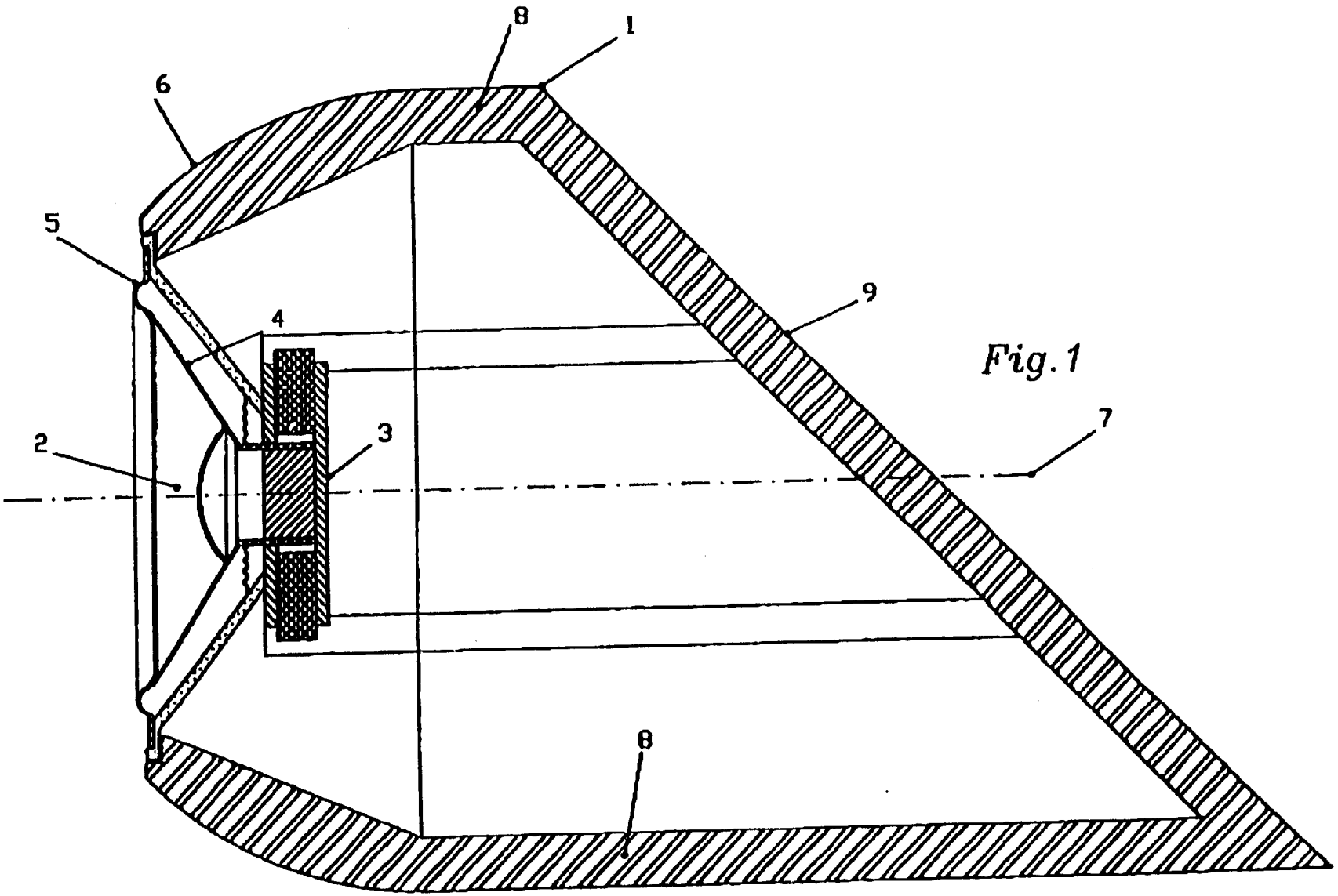
FIG. 1 is a cross-sectional view of a broadband loudspeaker according to the present invention.

The practical examples will be explained in more detail with reference to the drawings wherein:

FIG. 1 shows schematically the longitudinal section of the broadband loudspeaker, in which a sound transducer (2) with conical diaphragm (4) is installed in dome-shaped front (6), which can be fastened by means of diaphragm suspension (5) both in a frame or in enclosure (1). Driver unit (3) can also be joined to a frame or to enclosure (1) or to back wall (9). Diagonally positioned deflection plane (9) can be formed by the back wall. The conical internal contour deflects radially radiated sound components into the back region of enclosure (1), at the same time subjecting them to the elimination process described hereinabove.

Figures 2, 3, 3A:
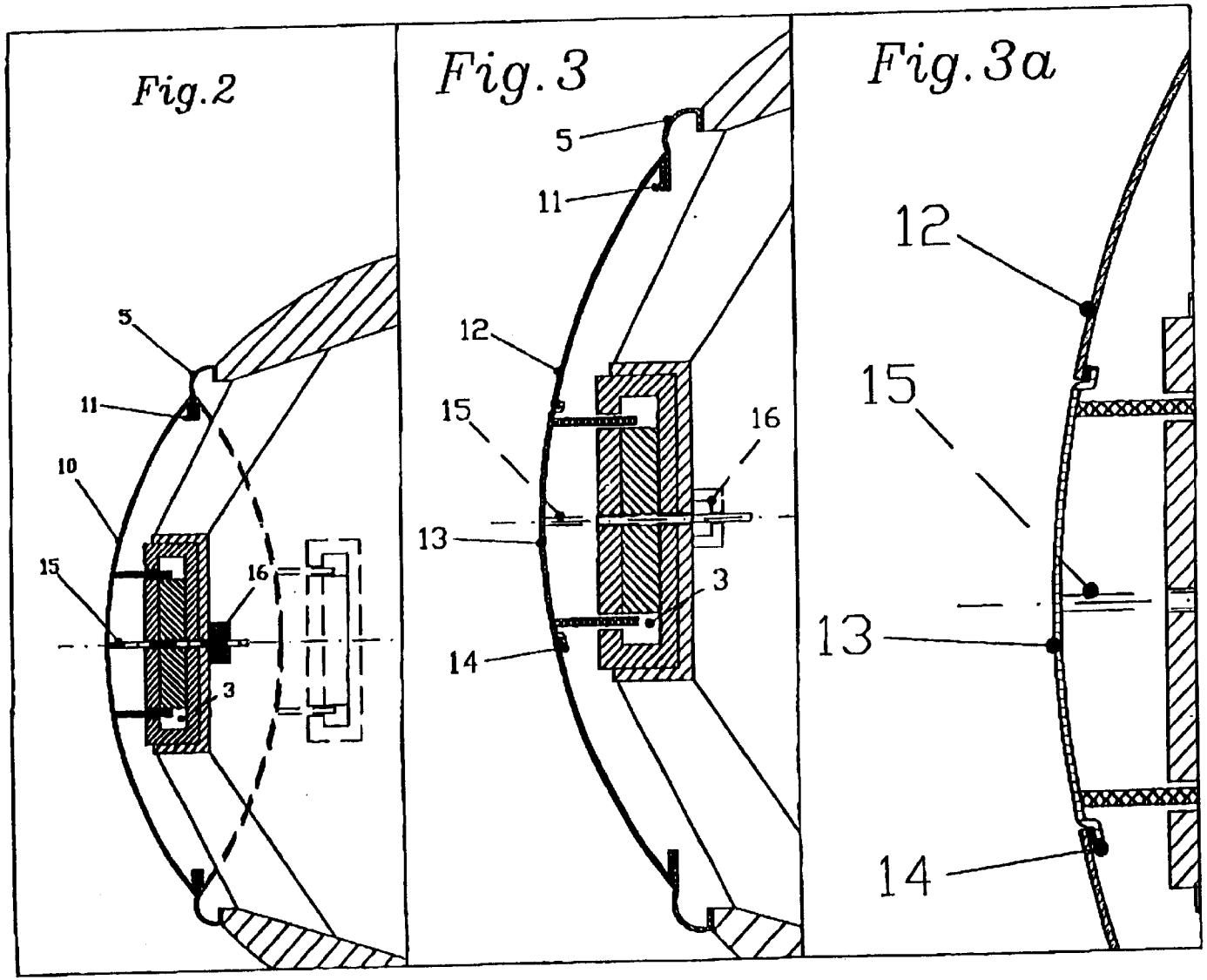
FIG. 2 is a partial cross-sectional view of the broadband loudspeaker according to the present invention showing convex and concave embodiments of the sound transducer.
FIG. 3 is a partial cross-sectional view of a broadband loudspeaker according to the present invention showing a cup-shaped diaphragm divided into an annular zone and a center zone.
FIG. 3*a* is an enlarged view showing a portion of FIG. 3.

FIG. 2 shows convex and concave (dashed line) versions of the sound transducer fastened directly to the enclosure together with driver unit (3) and diaphragm suspension (5). In this example centering axis (15) is supported at the end. Support (16) thereof is not described in further detail, but can also be, for example, an elastic lock bead.

FIG. 3 shows cup-shaped diaphragm (10) divided into annular zone (12) and center zone (13). The fastening of the zones to each other by means of elastic joint (14) is illustrated schematically. Annular zone (12) must be stiffened in the coupling region, expediently by bending it over. FIG. 3*a* shows an enlarged detail of this region.

Figure 4:
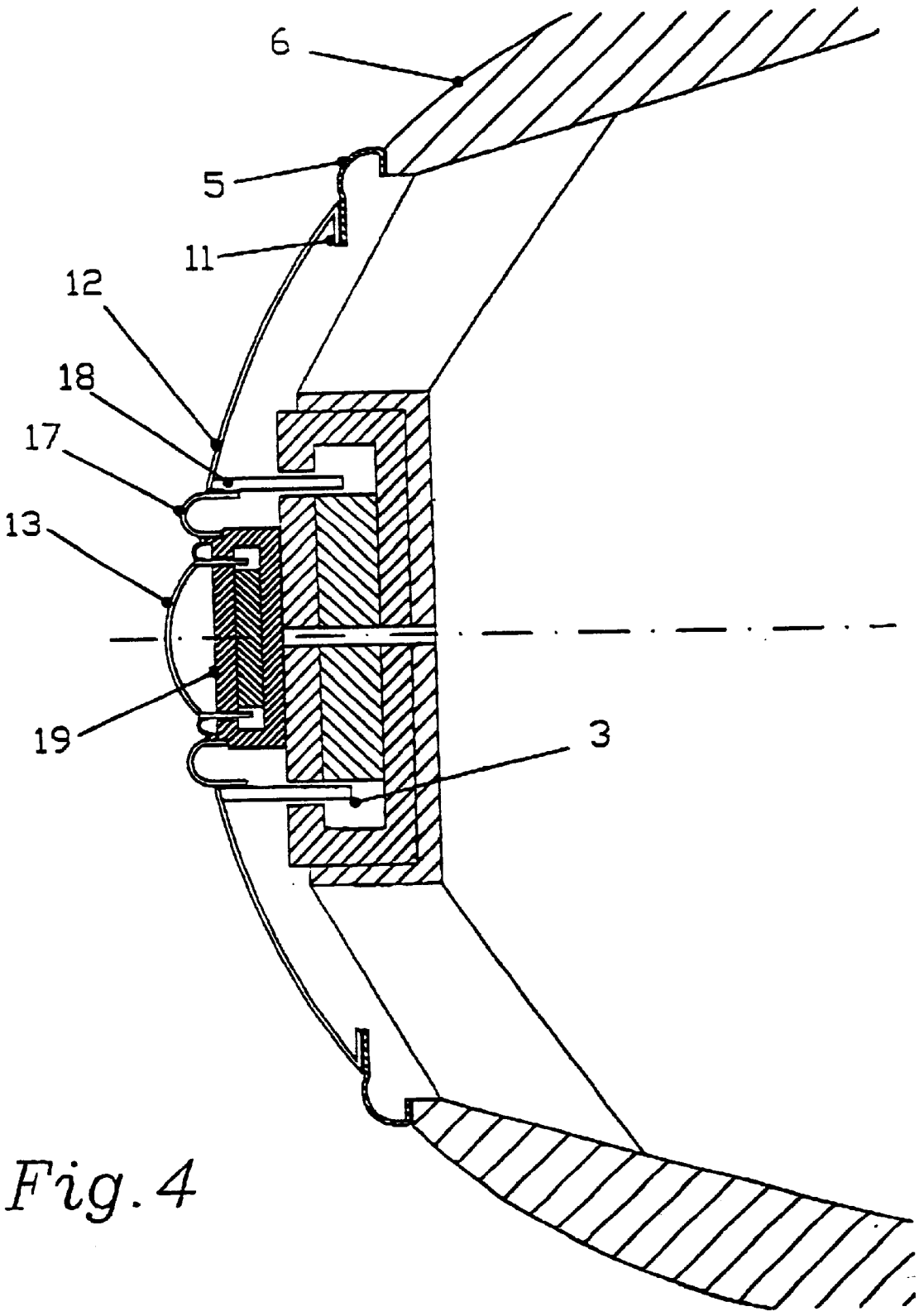
FIG. 4 is a partial cross-sectional view of another embodiment of a broadband loudspeaker according to the present invention with a separately driven center zone.

FIG. 4 shows an arrangement with separately driven center zone (13, 19). Inner diaphragm suspension (17) joins annular zone (13) with second driver (19) or with coil former (18). Center zone (13) is in this case equipped with its own diaphragm suspension and can represent a completely independent sound transducer.

Figure 5:
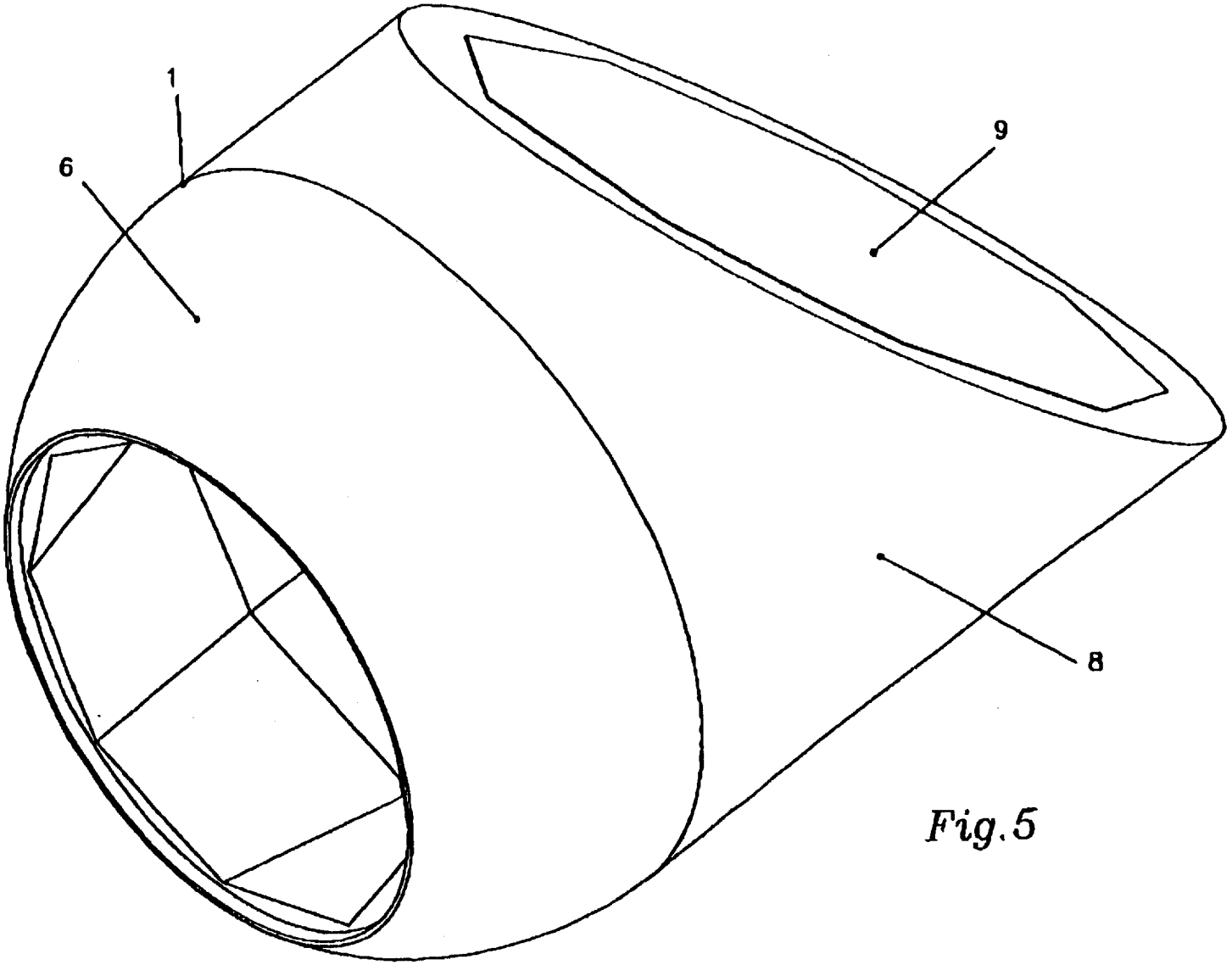
FIG. 5 is a perspective view of an enclosure for a broadband loudspeaker according to the present invention, without the loudspeaker.

FIG. 5 shows an enclosure (1) without loudspeaker in three-dimensional view. In this practical example the outside cross section is completely round while the internal space is polygonal, as the glimpse into the enclosure and the countersunk back wall (9) show.

Figure 6:
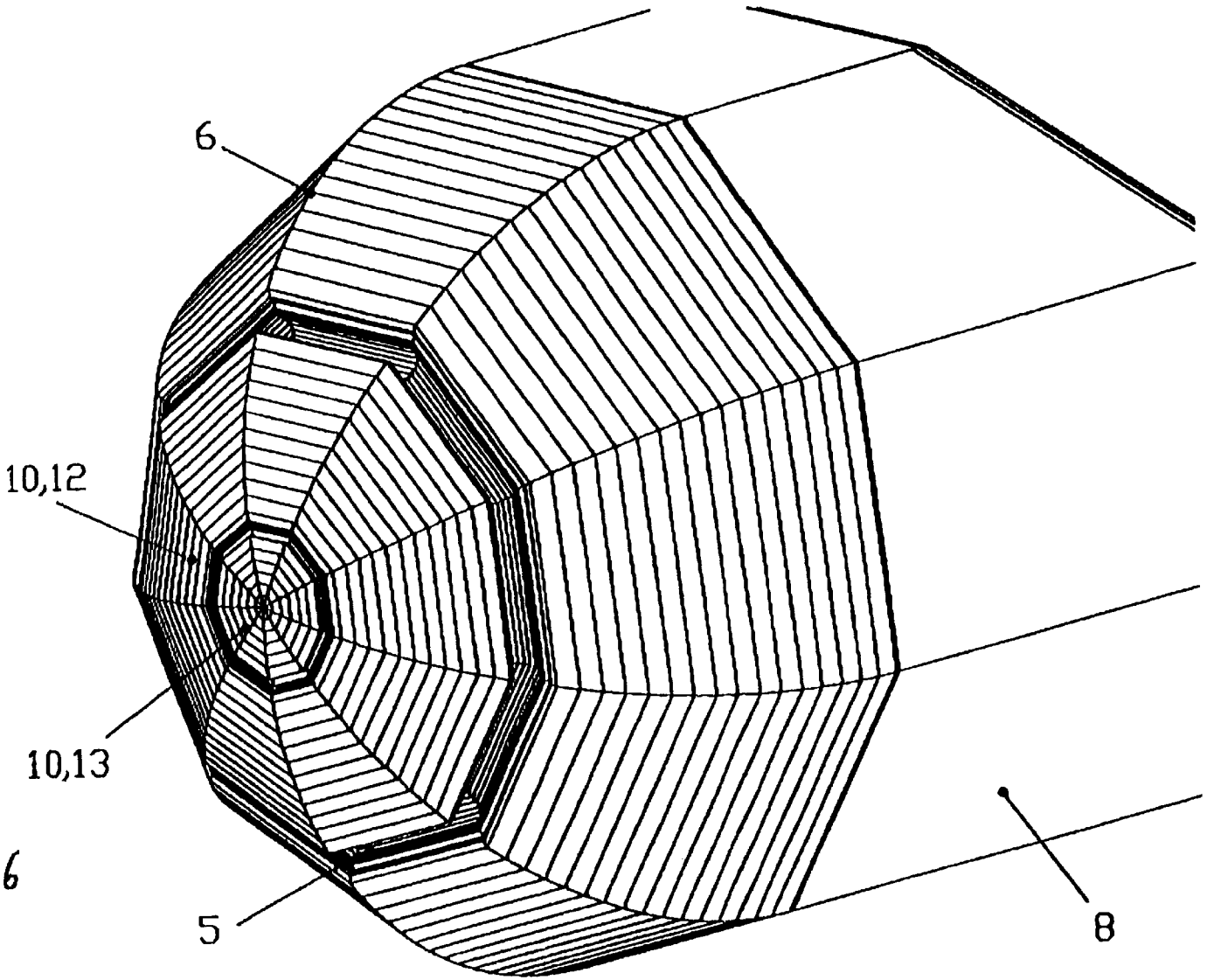
FIG. 6 is a perspective view of a broadband loudspeaker according to the present invention.

FIG. 6 shows a three-dimensional representation of FIG. 3. This view is also suitable for illustration of FIGS. 2 and 4. It corresponds to FIG. 2 if the break at the center is disregarded, but to FIG. 4 if this break is interpreted as the diaphragm suspension. At the same time, a practical combination of the two methods is shown by the polygonal outside contour of dome-shaped loudspeaker front (6).

What is claimed is:

1. A loudspeaker, comprising:

(a) an enclosure having (i) a dome-shaped loudspeaker front which flares rearwardly to an enclosure shell disposed coaxially around a central axis of the loudspeaker, and (ii) a back wall, (b) a sound transducer which is provided with a driver unit, the sound transducer being fastened to the dome-shaped loudspeaker front, (c) a diaphragm having a front side and a back side, (d) a diaphragm suspension, and (e) a diagonal deflection plane, which is disposed facing the back side of the diaphragm on the inside of the enclosure, wherein the inside cross-section of the enclosure shell defines a polygon, which has an odd number of sides.

2. The loudspeaker according to claim 1, wherein the angle between the deflection plane and the central axis of the loudspeaker is 45°.

3. The loudspeaker according to claim 1, wherein the diagonal deflection plane is positioned such that an open angle of the polygon faces the diagonal deflection plane.

4. The loudspeaker according to claim 1, wherein the internal contour of the dome-shaped loudspeaker front has a rearwardly conical shape from the outer fastening flange of the diaphragm to the enclosure shell.

5. The loudspeaker according to claim 1, wherein the enclosure shell has a conical shape.

6. The loudspeaker according to claim 1, wherein the diagonal deflection plate is formed by the back wall of the enclosure.

* * * * *